US009603218B1

(12) United States Patent
Bohler et al.

(10) Patent No.: US 9,603,218 B1
(45) Date of Patent: Mar. 21, 2017

(54) CONTROLLED COLOR TRANSITION

(71) Applicants: Christopher Lee Bohler, Peachtree City, GA (US); Li Li, Peachtree City, GA (US)

(72) Inventors: Christopher Lee Bohler, Peachtree City, GA (US); Li Li, Peachtree City, GA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 63 days.

(21) Appl. No.: 14/657,966

(22) Filed: Mar. 13, 2015

Related U.S. Application Data

(60) Provisional application No. 61/952,516, filed on Mar. 13, 2014.

(51) Int. Cl.
*H05B 33/08* (2006.01)

(52) U.S. Cl.
CPC ..... *H05B 33/0866* (2013.01); *H05B 33/0851* (2013.01); *H05B 33/0896* (2013.01)

(58) Field of Classification Search
None
See application file for complete search history.

(56) References Cited

U.S. PATENT DOCUMENTS 7,868,562 B2 * 1/2011 Salsbury ..... H05B 33/0869 315/300
8,928,250 B2 * 1/2015 Mays, II et al. ... H05B 33/0851 315/291

* cited by examiner

*Primary Examiner* — Dedei K Hammond
(74) *Attorney, Agent, or Firm* — King & Spalding LLP

(57) ABSTRACT

A method of iteratively adjusting a color of light emitted by a light source includes setting a weighted target color to an initial color of a light emitted by a light source. The method further includes determining a target color of the light by a color controller to iteratively adjust a color of the light to the target color of the light. The method also includes determining an updated weighted target color as a combination of a portion of the weighted target color and a portion of the target color. The method further includes adjusting the color of the light by the color controller to the weighted target color.

17 Claims, 6 Drawing Sheets

CONTROLLED COLOR TRANSITION

CROSS REFERENCE TO RELATED APPLICATIONS

The present application claims priority under 35 U.S.C. Section 119(e) to U.S. Provisional Patent Application No. 61/952,516, filed Mar. 13, 2014, and titled "Controlled Color Transition," the entire content of which is incorporated herein by reference.

TECHNICAL FIELD

The present disclosure relates generally to lighting solutions, and more particularly to color control for a lighting device.

BACKGROUND

The color of light emitted by a light source may need to change for a number of reasons. For example, it may be desirable for the light to have different colors associated with different luminosity levels of the light. In some cases, a change in the power provided to the light source may result in a very fast change in the luminosity of the light emitted by the light source. For example, a change in a dimmer setting may result in an increase or a decrease in the current provided to a light source, which may in turn result in a change in the luminosity of the light emitted by the light source. When a change in color of the light occurs, the change in color may be disruptive to those exposed to the light if the change occurs abruptly. In general, a change in the color the light, whether associated with a change in luminosity or not, may sometimes be disruptive to people.

Thus, a solution that allows for a gradual change in the color of a light emitted by a light source may be desirable to reduce the disruptive effect of an abrupt color change.

SUMMARY

The present disclosure relates generally to lighting solutions. In an example embodiment, a method of iteratively adjusting a color of light emitted by a light source includes setting a weighted target color to an initial color of a light emitted by a light source. The method further includes determining a target color of the light by a color controller to iteratively adjust a color of the light to the target color of the light. The method also includes determining an updated weighted target color as a combination of a portion of the weighted target color and a portion of the target color. The method further includes adjusting the color of the light by the color controller to the weighted target color.

In another example embodiment, a method of iteratively adjusting a color of light emitted by a light source includes initializing a weighted current to an initial current value and determining a real time current flowing through a light source. The real time current corresponds to a target color of the light, and a color of the light is to be iteratively adjusted to the target color of the light. The method further includes determining an updated weighted current as a combination of a portion of the weighted current and a portion of the real time current. The method also includes adjusting the color of the light by a color controller to correspond to the updated weighted current.

In another example embodiment, a lighting device for adjusting a color of a light includes a light source configured to emit a light and a driver to provide power to the light source. The lighting device further includes a dimmer in electrical communication with the driver. A real time current flowing through the light source corresponds to a setting of the dimmer. The lighting device also includes a color controller including a current measurement circuit. The color controller is to iteratively adjust a color of the light to match a target color of the light, and the target color of the light corresponds to the real time current. At each iteration, the color controller determines an updated weighted current based on a combination of a portion of a weighted current and a portion of the real time current. The weighted current corresponds to a current color of the light, and the color controller adjusts the color of the light to correspond to the updated weighted current.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
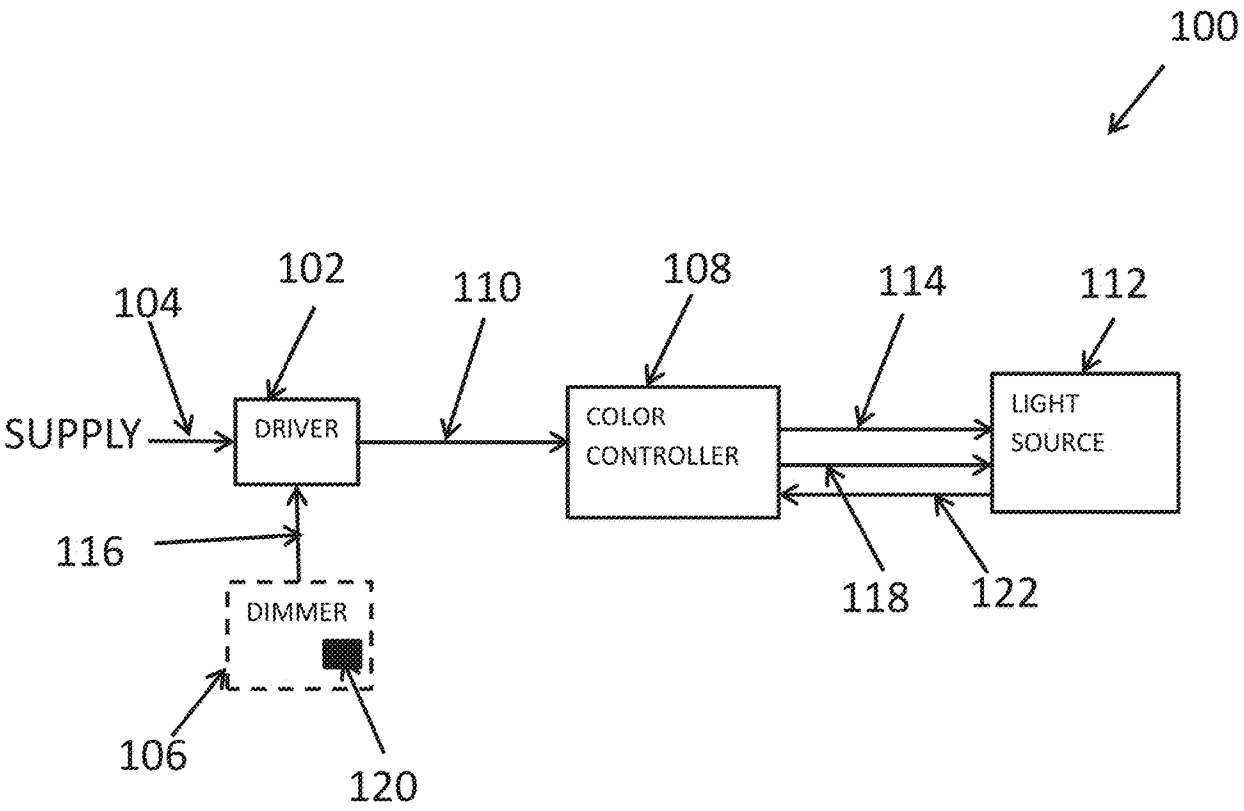
FIG. 1 is a block diagram of a system including a color controller for controlling the color of light emitted by a light source according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Turning now to the figures, particular embodiments are described. FIG. 1 is a block diagram of a system 100 including a color controller 108 for controlling the color of light emitted by a light source 112 according to an example embodiment. In some example embodiments, the system 100 may be implemented as a single device (e.g., a lighting device) or as multiple devices including a light device. In some example embodiments, the system 100 includes a driver 102, a dimmer 106, a color controller 108, and the light source 112. Power is supplied to the driver 102 from a power source (SUPPLY) via a supply connection 104. The power source (SUPPLY) may be an alternating current (AC) power source, such as the mains electricity supply of a house. For example, the power source (SUPPLY) may be a 120-volt, 60-Hertz power supply.

In some example embodiments, the driver 102 may generate output power from the power supplied by the power supply (SUPPLY). To illustrate, the output current/voltage of the driver 102 may be AC or direct-current (DC). The driver 102 may output voltage/current on a connection 110 that is coupled to the color controller 108. As illustrated in FIG. 1, the dimmer 106 is coupled to the driver 102 via a connection 116. The dimmer 106 may control the power output of the driver 102 by providing one or more control signals to the driver 102 via the connection 116. In general, the driver 102 and the dimmer 106 operate in conjunction with each other in a manner known to those of ordinary skill in the art.

In some example embodiments, the driver 102 may provide power to the plurality of light source 112. For example, power from the driver 102 may be provided to the light source 112 via the connection 110 and a connection 114 through the light control 108. Alternatively, the driver 102 may provide power to the light source 112 bypassing the color controller 108. For example, the connection 110 may be coupled to both the color controller 108 and to the light source 112.

In some example embodiments, the light source 112 may include one or more light emitting diodes (LEDs). The light source 112 may be one or more discrete LEDs, one or more organic light-emitting diodes (OLEDs), an LED chip on board that includes one or more discrete LEDs, an array of discrete LEDs, or light source(s) other than LEDs.

In some example embodiments, the driver 102 may be an LED driver or another driver compatible with the particular type of the light source 112. For example, the driver 102 may provide power to the light source 112 by converting AC power to direct-current (DC) power and providing the DC power to the light source 112. As described above, the driver 102 may provide power to the light source 112 through the light controller 108 as illustrated in FIG. 1 or without going through the color controller 108.

As described above, the driver 102 may adjust the amount of current the driver 102 outputs on the connection 110 based on the one or more control signals from the dimmer 106 that are provided to the driver 102 via the connection 116. To illustrate, the control signals on the connection 116 may be reflective of the setting of the dimmer 106. For example, the setting of the dimmer 106 may be set/adjusted using a dimmer knob 120 of the dimmer 106 or other dimmer setting means including electronic means.

In some example embodiments, the color controller 108 may control the light source 112 to change the color of the light emitted by the light source 112. For example, the different colors of the light emitted by the light source 112 can be expressed in correlated color temperature (CCT) using units of Kelvin (e.g., 1800 K). Accordingly, adjustment of color of the light may correlate to adjustment in the CCT of the light, and vice versa.

In some example embodiments, the color controller 108 may adjust the overall color of the light emitted by the light source 112 by changing the contribution from one or more light sources of the light source 112 to the overall light emitted by the light source 112. To illustrate, the color controller 108 may provide color control signals to the light source 112 via connections 118. The light source 112 may include different groups of light sources, and each group of light sources may be designed to emit a respective color light. Each one of the color control signals provided on the connections 118 may control, for example, the duration of time current is provided to a respective group of light sources of the light source 112.

To adjust the color of the light emitted by the light source 112, the color controller 108 may adjust the durations of time current is provided to the individual groups of the light sources. By controlling the duration of time that current is provided to the different groups of light sources of the light source 112 that emit different lights with different colors (e.g., one group emits red light, another group emits green light, . . . ), the color controller 108 may adjust the contribution of the different color lights emitted by the different group of light sources to the overall light emitted by the light source 112. By adjusting the contribution of the different color lights emitted by the different groups of light sources, the color controller 108 may adjust the overall color of the light emitted by the light source 112. In some alternative embodiments, the color controller 108 may adjust the color of the light emitted by the light source 112 in a different manner without departing from the scope of this disclosure.

In some example embodiments, different dimmer setting values may correspond to respective values of the real time current provided to the light source 112. Different dimmer setting values may also correspond to respective luminosity values (lumens) of the light emitted by the light source 112, which generally correspond to the real time current values. When the dimmer setting is changed, the color of the light emitted by the light source 112 may need change to a target color (e.g., a target color in CCT with units of Kelvin) that corresponds to the new dimmer setting value (which corresponds to a respective real time current provided to the light source 112 and to a respective luminosity of the light emitted by the light source 112). To avoid an abrupt change in the color of the light resulting from the change in the dimmer setting, the color controller 108 may change the color of the light emitted by the light source 112 gradually instead of abruptly. To illustrate, the color controller 108 may change the color of the light in iterative steps such that the color of the light gradually matches the target color after several iterations of color adjustments instead of after a single color adjustment step. For example, for some or all iterations of color adjustments, the color controller 108 may change the color of the light to a different color that more closely matches the color of the light in the immediate prior iteration than the target color corresponding to the new dimmer setting value.

Figure 5A:
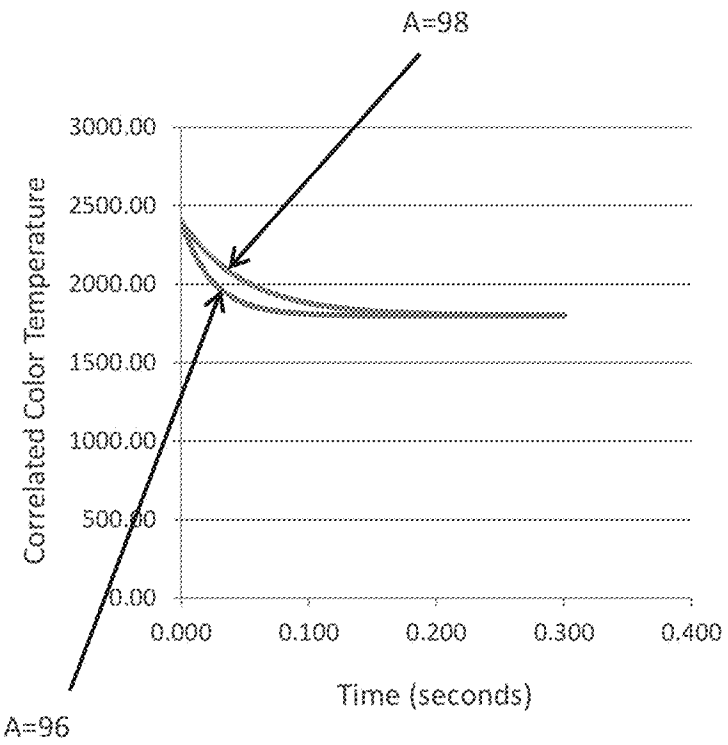
FIGS. 5A and 5B are plots of color temperature of light emitted by the light source of FIG. 1 illustrating gradual change of the color temperature according to an example embodiment.
Figure 5B:
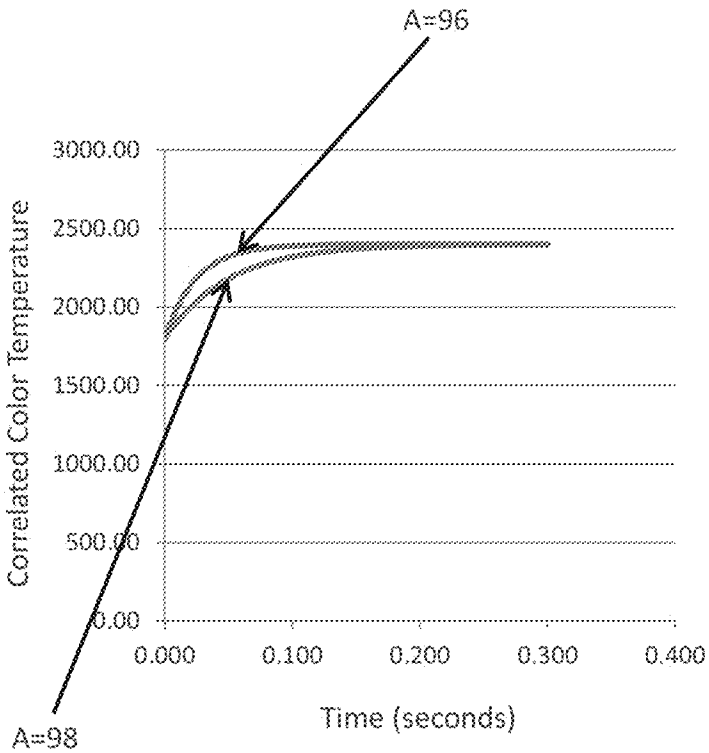

To illustrate, the color controller 108 may change the color of the light based on a first percentage of the color of the light (e.g., a first percentage of the CCT in K) in an immediately prior iteration and a second percentage of the target color (e.g., a second percentage of the target CCT in K), where the first percentage may be a much larger number than the second percentage. Thus, each iteration of color adjustment causes the color of the light emitted by the light source 112 to incrementally approach the target color while substantially avoiding an abrupt color change toward the target color. As illustrated in FIGS. 5A and 5B, the color adjustment may also be performed in a non-linear manner, which may be less disruptive to people than a linear change of the color of the light.

In general, the color controller 108 may iteratively change the color of the light emitted by the light source 112 in response to a number of situations. For example, the color controller 108 may control and adjust the color of the light emitted by the light source 112 based on a dimmer setting of the dimmer 106, the luminosity of the light emitted by the light source 112, and/or the current flowing through the light source 112. As described above, the color controller 108 may change the color of the light in response to a change in a dimmer setting of the dimmer 106. The dimmer setting of the dimmer 106 may be provided to the color controller 108 in various formats. For example, the physical position of a dimmer knob 120 (which may be a slider or another kind of knob) or a percentage (e.g., 30%) of the maximum dimmer setting, where the maximum dimmer setting corresponding to the maximum current the driver 102 provides to the light source 112, may be provided to the color controller 108. The dimmer setting may be detected by the color controller 108, provided to the color controller 108 by the dimmer 108, or provided to the color controller 108 by other means such as a user input interface.

The color controller 108 may also change the color of the light in response to a change in the luminosity (e.g., in lumens) of the light emitted by the light source 112. For example, when the dimmer setting of the dimmer 106 is changed, the real time current flowing through the light source 112 may change accordingly. The change in the current may result in a corresponding change in the luminosity of the light emitted by the light source 112. The color controller 108 may determine the luminosity of the light emitted by the light source 112 and gradually adjust the color of the light to a target color that corresponds to the luminosity of the light. The color controller 108 may iteratively adjust the color of the light to correspond to the target color in manner described above with respect to iterative color adjustment in response to a change in dimmer setting. The color controller 108 may determine the luminosity of the light emitted by the light source 112 directly using one or more components that are inside the color controller 108 or using a device (e.g., a luminance meter) that is connected to the color controller 108.

Similarly, the color controller 108 may determine the amount of real time current flowing through the light source 112 and gradually adjust the color of the light emitted by the light source 112 to a target color corresponding to the real time current. For example, the real time current flowing through the light source 112 may be provided to the controller 108 via a connection 122. Alternatively or in addition, the color controller 108 may change the color of the light based on an input (e.g., a color selection input) to the color controller 108 or the system 100. The color controller 108 may also change the color of the light based on other events and/or situations that are, for example, detected by the system 100.

Although the system 100 includes the dimmer 106 as shown in FIG. 1, in some alternative embodiments, the dimmer 106 may be omitted or may be integrated into another component such as the driver 102. Further, in some alternative embodiments, the dimmer knob 120 may be an electronic interface. In some example embodiments, the color controller 108 may be a standalone circuit, onboard circuitry embedded into a main board, or circuitry integrated into a constant current driver to reduce the total number of parts. The connections 104, 110, 114, 116, 118 may each represent more than a single connection. For example, one or more of the connections 104, 110, 114, 116, 118 may include one or more electrical wires.

Figure 2:
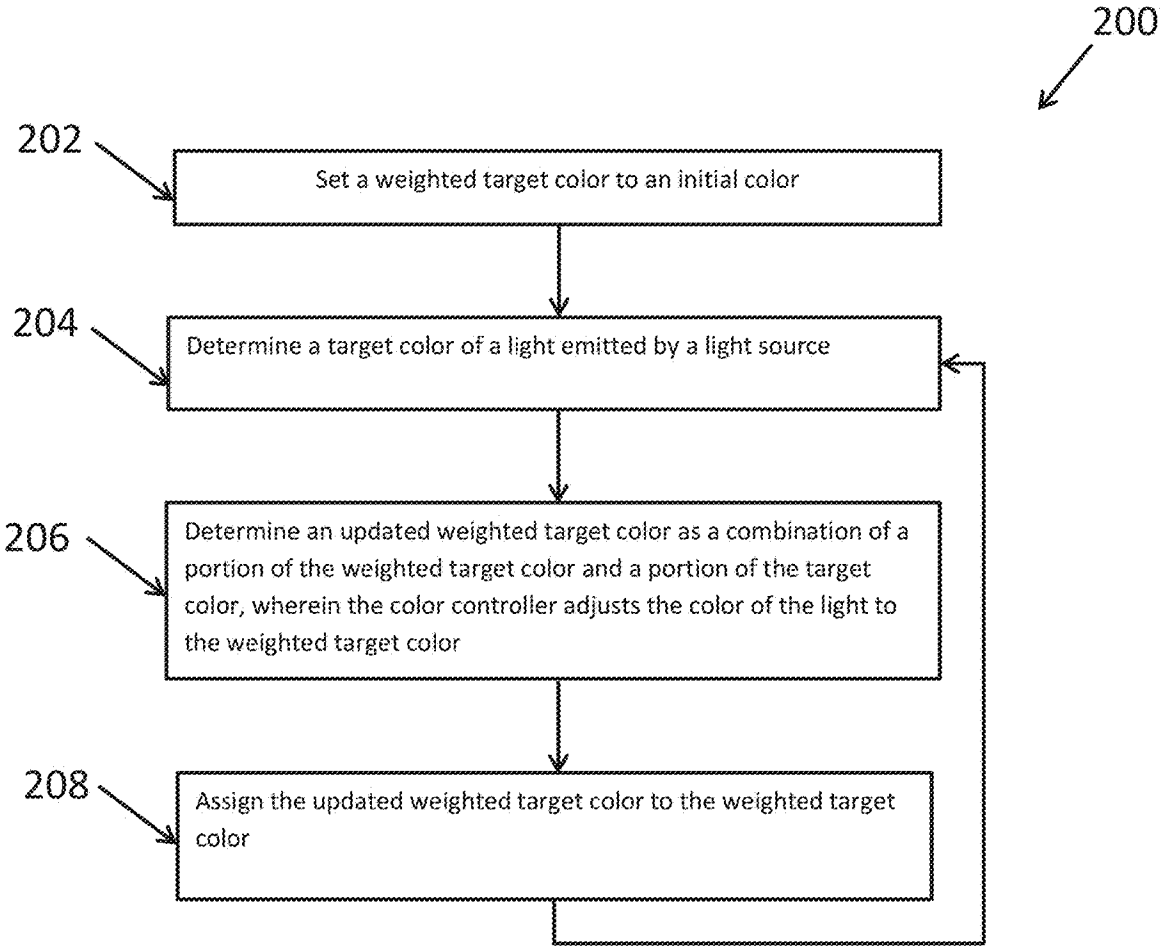
FIG. 2 is a flowchart illustrating a method of iteratively adjusting the color of the light emitted by the light source of FIG. 1 according to an example embodiment.

FIG. 2 is a flowchart illustrating a method 200 for iteratively adjusting a color of a light emitted by a light source according to an example embodiment. For example, the method 200 may be implemented using the system 100 of FIG. 1. Referring to FIGS. 1 and 2, the method 200 includes setting a weighted target color to an initial color at step 202. For example, at initialization (e.g., at power-up) of the light source 112, the weighted target color may be set to an initial color (e.g., a CCT value of 1700 K). The initial color may be set based on, for example, to a light color that is generally preferable by users. In general, the weighted target color, the initial color, and other colors as described with respect to the method 200 may be represented in correlated color temperature (CCT) using units of Kelvin (e.g., 2100 K).

At step 204, the method 200 includes determining a target color of the light emitted by the light source. To illustrate, the target color of the light may correspond to the luminosity of the light emitted by the light source 112 as well as the real time current flowing through the light source 112. The luminosity of the light as well as the real time current may correspond to an initial setting of the dimmer or a changed dimmer setting. For example, the target color may be 2400 K.

In some example embodiments, to determine the target color of the light, the color controller 108 of FIG. 1 may first determine the luminosity of the light emitted by the light source 112 or the real time current flowing through the light source 112. For example, the color controller 108 may then determine the target color based on association between luminosity (i.e., lumens) of light emitted by the light source 112 and color (e.g., CCT) of the light emitted by the light source 112. Alternatively, the color controller 108 may determine the target color based on association between real time current flowing through the light source 112 and color (e.g., CCT) of the light emitted by the light source 112. For example, the color controller 108 may determine the target color as 1800 K based on the luminosity of the light or based on the real time current.

In some alternative embodiments, the color controller 108 may determine the target color using one or more parameters other than luminosity and real time current. For example, the color controller 108 may determine the target color based on a color selection input that, for example, directly provides a CCT value as the target color or that otherwise indirectly indicates the target color. The target color may also be associated with parameters that are not associated with luminosity or real time current.

At step 206, the method 200 includes determining an updated weighted target color as a combination of a portion of the weighted target color and a portion of the target color. The portion of the weighted target color is based on a non-linear weighting coefficient to optimize eye adaptation. For example, the color controller 108 may determine the updated weighted target color by combining a percentage of the weighted target color and a percentage of the target color determined at step 204. In some example embodiments, the color controller 108 may determine the updated weighted target color as follows:

$$\text{Updated Weighted Target Color}=(\text{Weighted Target Color}\times A\ \%)+(\text{Target Color}\times((1-A)\%)) \quad \text{Eq. 1}$$

In Eq. 1, the updated weighted target color, the weighted target color, and the target color may be represented in CCT using units of Kelvin or in another manner known to those of ordinary skill in the art, such as CIE x,y values. In Eq. 1, A and (1−A) are weighting coefficients. In general, the weighting coefficient A is selected to provide a gradual adjustment of the light in a manner that is not disruptive to people exposed to the light. In some example embodiments, the weighting coefficients may be dynamically adjusted in the manufacturing process or by the end-user.

Once the color controller 108 determines the updated weighted target color, the color controller 108 can adjust the color of the light to the updated weighted target color, for example, using the color control signal provided to the light source 112 via the connections 118, or in another manner known to those of ordinary skill in the art. As described above, each of the updated weighted target color, the weighted target color, and the target color as well as the color of the light in general may be expressed in terms of correlated color temperature (CCT) or in another manner known to those of ordinary skill in the art, such as CIE x,y values. For example, a CCT of the light may be measured using components that are integrated in the color controller 108 or using a device (e.g., a luminance meter) that is external to the color controller 108 of FIG. 1 as known those of ordinary skill in the art. To illustrate, luminosity of the light emitted by the light source 112 or amounts of real time current provided to the light source 112 or flowing through the light source 112 may be associated with corresponding CCT values of the light.

In some example embodiments, the weighting coefficient A may range from approximately 90 to approximately 99. In some alternative embodiments, the weighting coefficient A may range from 95 to 98. In general, the weighting coefficient A may be any value between 0 and 100 that results in a desired rate of transition of the color of the light emitted by the light source 112. For example, the weighting coefficient A may be set to a value that results in a smooth transition that is generally non-disruptive to a person exposed to the light emitted by the light source 112. In some example embodiments, by setting the weighting coefficient A to a relatively high number (e.g., 96, 98, etc.), the weighted target color (which is set in step 202 at initialization or in step 208 below of an immediately prior iteration) can be more dominant than the target color in the updated weighted target color determined in step 206. For example, the dominance of the weighted target color over the target color at step 206 of individual iterations of the method 200 can reduce risk of an abrupt change to the target color during any particular iteration and during the overall adjustment of the color of the light emitted by the light source 112.

At step 208, the method 200 includes assigning the updated weighted target color to the weighted target color. In some example embodiments, step 208 concludes a single iteration of adjustment of the color of the light emitted by the light source 112. For example, each iteration from step 204 to step 208 may take approximately 1 millisecond. Once the updated weighted target color is assigned to the weighted target color, the method 200 continues at step 204, wherein the color controller 108 determines the target color, based on the weighted target color from step 208. The target color may have changed from the immediately prior iteration (for example, due to a change in dimmer setting) or may be the same as in the immediately prior iteration, if, for example, the dimmer setting of the dimmer 106 has not changed. For example, the target color may be approximately 2400 K during one iteration, approximately 2300 K during another iteration, so on and on, for example, due to a change in the dimmer setting. Alternatively, the target color may remain approximately the same (e.g., 2400 K) during multiple iterations of the steps 204-208 of the method 200. In general, after multiple iterations, the color of the light substantially matches the target color as the weighted target color more closely matches the target color with each iteration.

To illustrate using an initial color of 1700 K, a weighting coefficient of 98, and a target color of 2400 K, the updated weighted target color is 1714 during a first iteration of the method 200 and 1727.72 during a second iteration of the method 200. In the second iteration of the method 200, the weighted target color is set to 1714, which is the updated weighted target color determined in the first iteration.

In some example embodiments, the method 200 may include other steps before, after, and/or in between the steps 202-208. Further, in some alternative embodiments, some of the steps of the method 200 may be performed in a different order than shown in FIG. 2.

Figure 3:
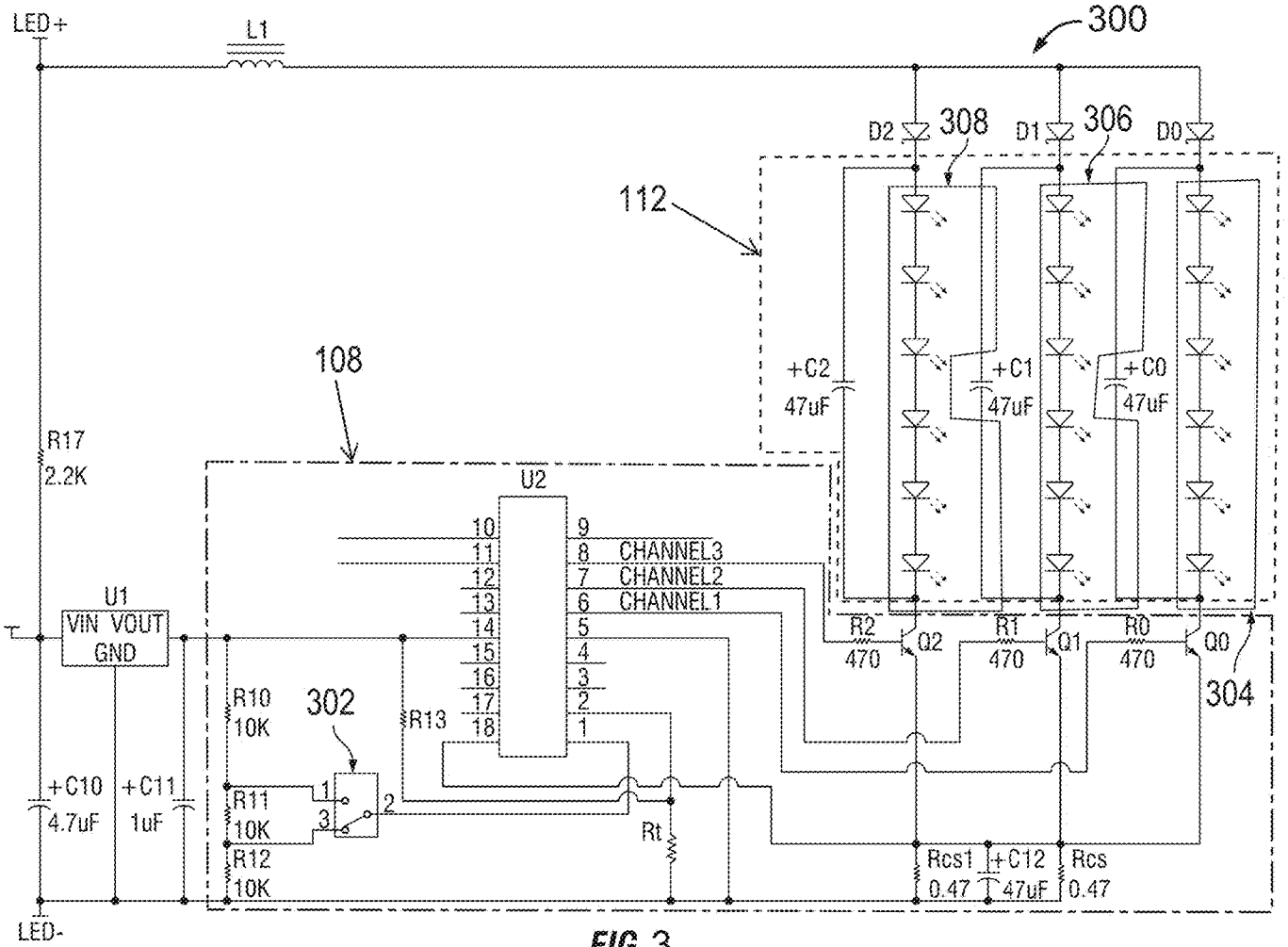
FIG. 3 is illustrates a lighting device including a schematic diagram of the color controller of FIG. 1 according to an example embodiment.

FIG. 3 illustrates a lighting device 300 including a schematic diagram of the color controller 108 and the light source 112 of FIG. 1 according to an example embodiment. The color controller 108 includes a controller U2 and a switch 302. The switch 302 may be used to provide a user input to the controller U2. The light source 112 includes three groups of LEDs 304, 306, 308. Each group of LEDs 304, 306, 308 may emit a particular color light that is different from the color of light emitted by the other groups of LEDs 304, 306, 308. The color of the light emitted by the light source 112 is a combination of the colors of the lights emitted by the three groups of LEDs 304, 306, 308.

A voltage regulator U1 is electrically coupled to the power output of an LED driver, such as the driver 102 of FIG. 1, via ports LED+ and LED−. For example, the voltage difference between ports LED+ and LED− may be between 18-22 volts, and the voltage at the input pin (Vin) may be between 5 and 12 volts. An output pin (Vout) of the voltage regulator U1 is coupled to a power pin (pin 14) of the controller U2 to provide power to the controller U2. For example, the voltage at the output pin (Vout) may be approximately between 4 volts and 5 volts.

An LED driver, such as the LED driver 102 of FIG. 1, may provide current to the light source 112 through an inductor Ll. The controller U2 can control transistors Q0, Q1, Q2 using color control signals Channel1, Channel2, and Channel3, respectively, to enable and disable current flow through the respective group of LEDs 304, 306, 308 individually. For example, during a particular time period, the duration of current flow through each group of LEDs 304, 306, 308 may depend on the pulse width of the respective control signal Channel1, Channel2, and Channel3. By changing the durations of current flow through the different groups of LEDs 304, 306, 308 that may each contribute a different color to the over color of the light emitted by the light source 112, the color controller 108 can adjust the color of the combined light emitted by the light source 112.

For example, the color controller 108 can iteratively adjust the color of the light emitted by the light source 112 to match the updated weighted target color above described with respect to FIG. 2. For example, when the real time current flowing through the light source 112 changes, for example, due to a change in the dimmer setting of the dimmer 106 of FIG. 1, the color control 108 may change the color of the light emitted by the light source 112 to match a target color corresponding the new real time current value. To illustrate, the controller U2 can determine the real time current that flows through the groups of LEDs 304, 306, 308 using an analog-to-digital (A/D) conversion module (for example, an A/D converter inside the controller U2) and resistors Rcs1 and Rcs2. Alternatively, the color controller 108 may determine the real time current using other means known to those of ordinary skill in the art. Based on the real time current that flow through the light source 112, the controller U2 can determine an updated weighted current that corresponds to the updated weighted target color described with respect to the method 200 of FIG. 2 and update the color of the light emitted by the light source 112 to correspond to the updated weighted current. For example, the controller U2 can determine the updated weighted current in a manner described below with respect to FIG. 4.

At each iteration of color adjustment performed by the color controller 108, the color controller 108 can change, in a manner described above, the color of the light emitted by the light source 112 to the updated weighted target color corresponding to the updated weighted current. For example, the controller U2 may change the duty cycle of the control signal to change the contribution of light from the different groups of LEDs 304, 306, 308 to the overall light emitted by the light source 112. After multiple such iterations, the color of the light emitted by the light source 112 substantially matches the target color that corresponds to the real time current flowing through the light source 112.

Generally, the real time current flowing through the light source 112 is the same as the current provided to the light source 112. Accordingly, in some example embodiments, the controller U2 may determine the current provided to the light source 112 for the purpose of adjusting the color of the light emitted by the light source 112. In general, the color controller 108 may determine the real time current that flows through the light source 112 in a manner other than described herein without departing from the scope of this disclosure.

In some example embodiments, the controller U2 may be a microprocessor or microcontroller. For example, the controller U2 may be an integrated circuit device from Microchip Technology (e.g., part number PIC16F1827). Alternatively, the controller U2 may be implemented in multiple circuits and components, in an FPGA, an ASIC, or a combination thereof. In some example embodiments, the controller U2 may include one or more memory devices for storing code that may be executed by the controller U2 to perform one or more of the operations described above. The one or more memory devices may also be used to store data by the controller U2. Alternatively or in addition, the controller U2 may access software code and data, and store data in a memory device that is outside of the color controller 108. Although three groups of LEDs 304, 306, 308 are shown in FIG. 3, in some alternative embodiments, the light source 112 may include fewer or more than three groups LEDs. For example, the light source 112 may include a single LED or one or more LEDs in a different configuration than shown in FIG. 3 without departing from the scope of this disclosure.

In some example embodiments, the lighting device 200 may include capacitors C0, C1, C2 that may smooth out transitions of current flow through the respective group of LEDs 304, 306, or 308 when the respective transistor Q0, Q1, Q2 switches between the on-state and the off-state based on the respective control signal Channel1, Channel2, or Channel3.

Although example values of some elements (e.g., Rcs) of the lighting device 300 are shown in FIG. 3, the values are for illustrative purposes, and other values may be used without departing from the scope of this disclosure. Further, some elements of the lighting device 300 shown in FIG. 3 may be omitted or substituted with other components without departing from the scope of this disclosure. Further, the controller U2 may generate few or more than the number of control signals shown in FIG. 3.

Each group of LEDs 304, 306, 308 may include more or fewer LEDs than shown in FIG. 3 without departing from the scope of this disclosure. In some alternative embodiments, the light source 112 may include LEDs that are configured in a different manner that shown in FIG. 3 without departing from the scope of this disclosure.

In some example embodiments, the controller 108 may provide the control signals Channel1, Channel2, Channel3 to the light source 112 via the connection 118 shown in FIG. 1. The real time current flowing through the groups of LEDs 304, 406, 308 of the light source 112 may be provided to the controller 108 via the connection 122 shown in FIG. 1.

Figure 4:
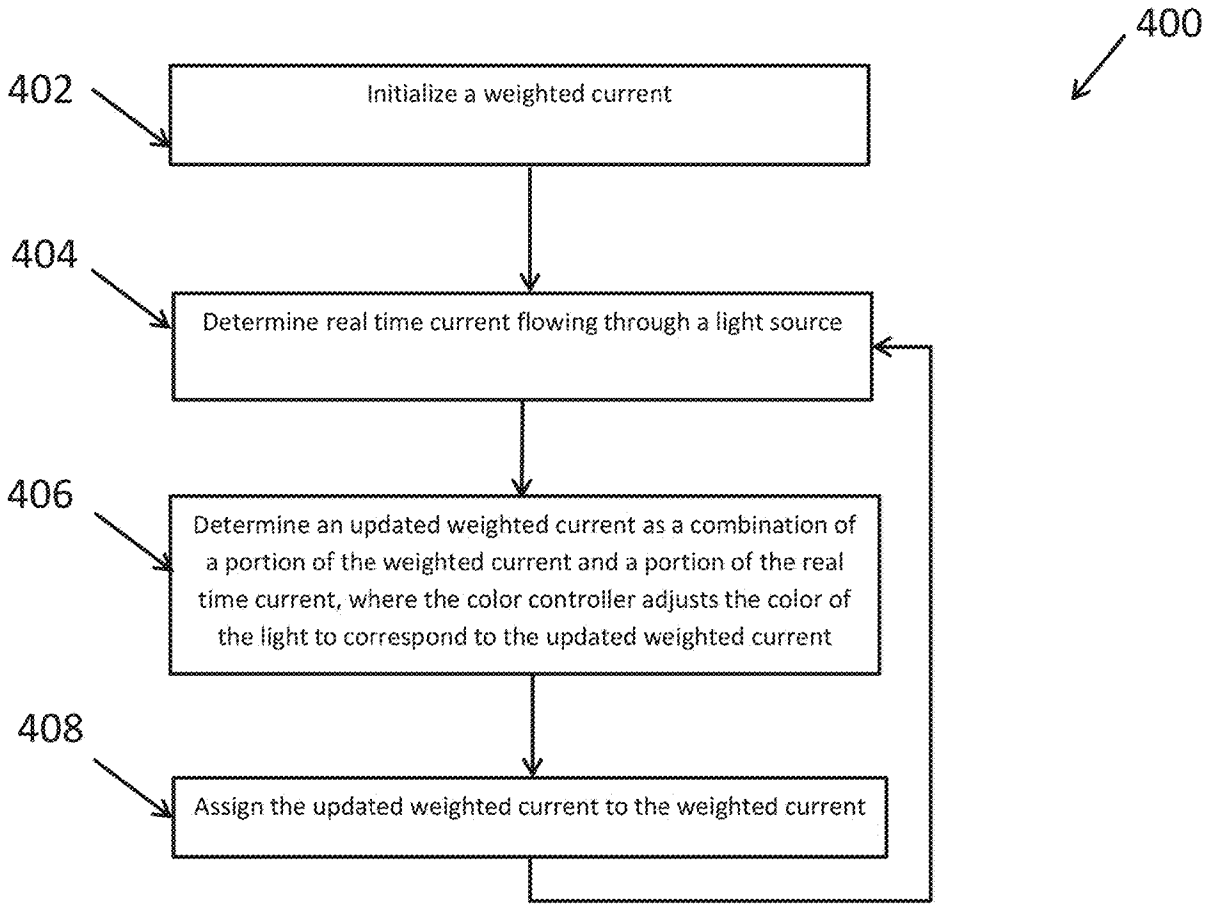
FIG. 4 is a flowchart illustrating iterative adjustment of the color of the light emitted by the light source of FIG. 3 based on current flowing through the light source according to an example embodiment.

FIG. 4 is a flowchart illustrating a method 400 of iterative adjustment of the color of the light emitted by a light source based on real time current flowing through the light source according to an example embodiment. For example, the method 400 may be implemented using the color controller 108 of FIGS. 1 and 3.

Referring to FIGS. 1, 3 and 4, the method 400 includes initializing a weighted current at step 402. For example, at power-up, the weighted current may be set to 0 amps. At step 404, the method 400 includes determining the real time current flowing through the light source such as the light source 112. For example, the color controller 108 may determine the current flowing through the light source 112 as described above with respect to FIG. 3. As described above, the real time current may change, for example, in response to a change in the setting of the dimmer 106 shown in FIG. 1.

At step 406, the method 400 includes determining an updated weighted current as a combination of a portion of the weighted current and a portion of the real time current at step 406. The portion of the weighted current is based on a non-linear weighting coefficient to optimize eye adaptation. To illustrate, during each iteration through the step 406, the color controller 108 may determine the updated weighted current as a combination of a percentage of the weighted current and a percentage of the real time current (which corresponds to the target color described with respect to FIG. 2) determined at step 404. In some example embodiments, the color controller 108 may determine the updated weighted current as follows:

$$\text{Updated weighted current} = (\text{Weighted current} \times B\ \%) + (\text{Real time current} \times (1 - B\ \%)) \qquad \text{Eq. 2}$$

In some example embodiments, the updated weighted current of Eq. 2 corresponds to the updated weighted target color of Eq. 1; the weighted current of Eq. 2 corresponds to the weighted target color of Eq. 1; and the real time current of Eq. 2 corresponds to the target color of Eq. 1. Further, in Eq. 2, B and (1-B) are weighting coefficients described with respect to the method 200 of FIG. 2. For example, the weighting coefficient B may range from approximately 90 to approximately 99 (e.g., 98). In some alternative embodiments, the weighting coefficient B may range from 95 to 98. In general, the weighting coefficient B is selected to provide a gradual adjustment of the light in a manner that is not disruptive to people exposed to the light. In some example embodiments, the weighting coefficients may be dynamically adjusted on the manufacturing line or by the end-user.

Once the color controller 102 determines the updated weighted current based on Eq. 2, the color controller 108 may adjust the color of the light emitted by the light source 112 to correspond to the updated weighted current. For example, the color controller 108 may include a table that is used to map the updated weighted current to a color temperature or one or more other parameters for setting the color of the light emitted by the light source 112. Alternatively, the color controller 108 may associate the updated weighted current to a particular color (for example, in terms of color temperature) using means other than a mapping table. As described above, the color controller 108 may update the color of the light emitted by the light source 112 by changing the contribution of the different color lights emitted by the different light sources of the light source 112.

At step 408, the method 400 further includes assigning the updated weighted current to the weighted current. In some example embodiments, step 408 concludes a single iteration of adjustment of the color of the light emitted by the light source 112, and the method 400 continues at step 404. With each iteration, the updated weighted current gets closer to the real time current. In some example embodiments, each iteration of the steps 404-408 may take approximately 1 millisecond. In general, after multiple iterations of color adjustment, the color of the light emitted by the light source substantially matches the target color (corresponding to the real time current through the light source 112) as the weighted target color more closely matches the target color with each iteration.

In some example embodiments, the method 400 may include other steps before, after, and/or in between the steps 402-408. Further, in some alternative embodiments, some of the steps of the method 400 may be performed in a different order than shown in FIG. 4.

FIGS. 5A and 5B are plots of correlated color temperature (CCT) values (in Kelvin) of light emitted by the light source 112 of FIGS. 1 and 3 illustrating gradual change of the color temperature according to an example embodiment. FIGS. 5A and 5B illustrate gradual changes of the light emitted by the light source 112 based on two values of the weighting coefficient A of 96 and 98. FIG. 5A illustrates a gradual decrease in the CCT of the light, and FIG. 5B illustrates a gradual increase in the CCT of the light. As illustrated in FIGS. 5A and 5B, the change in the correlated color temperature is non-linear. In general, non-linear change in the color of the light is less disruptive to the human eye than a linear change.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A method of iteratively adjusting a color of light emitted by a light source, the method comprising:

setting a weighted target color to an initial color of a light emitted by a light source;

determining a target color of the light by a color controller to iteratively adjust a color of the light to the target color of the light;

determining an updated weighted target color as a combination of a portion of the weighted target color and a portion of the target color, wherein the portion of the weighted target color is a weighting coefficient % of the weighted target color, wherein the portion of the target color is (1−the weighting coefficient) % of the target color, and wherein the updated weighted target color is a sum of the portion of the weighted target color and the portion of the target color; and adjusting the color of the light by the color controller to the weighted target color.

2. The method of claim 1, further comprising assigning the updated weighted target color to the weighted target color.

3. The method of claim 2, further comprising repeating the step of determining the target color of the light, determining the updated weighted target color, adjusting the color of the light to the weighted target color, and assigning the updated weighted target color to the weighted target color.

4. The method of claim 1, wherein the weighting coefficient ranges from approximately 90 to approximately 99.

5. The method of claim 1, wherein the initial color, the weighted target color, the target color, and the updated weighted target color are represented in correlated color temperature values.

6. The method of claim 1, wherein the light is a combination of lights having different colors, wherein adjusting the color of the light to the weighted target color comprises changing a contribution of at least a first light of the lights to the light, wherein the first light has a first color.

7. The method of claim 1, wherein the target color of the light corresponds to a luminosity of the light and wherein determining the target color of the light includes determining the luminosity level of the light.

8. The method of claim 1, wherein the target color of the light corresponds to a real time current flowing through the light source and wherein determining the target color of the light includes determining the real time current flowing through the light source.

9. A method of iteratively adjusting a color of light emitted by a light source, the method comprising:

initializing a weighted current to an initial current value;

determining a real time current flowing through a light source, the real time current corresponding to a target color of the light, wherein a color of the light is to be iteratively adjusted to the target color of the light;

determining an updated weighted current as a combination of a portion of the weighted current and a portion of the real time current, wherein the portion of the weighted current is a weighting coefficient % of the weighted current, wherein the portion of the real time current is (1−the weighting coefficient) % of the real time current, and wherein the updated weighted current is determined by adding the portion of the weighted current to the portion of the real time current; and adjusting the color of the light by a color controller to correspond to the updated weighted current.

10. The method of claim 9, further comprising assigning the updated weighted current to the weighted current.

11. The method of claim 10, further comprising repeating the step of determining the real time current flowing through the light source, determining the updated weighted current, adjusting the color of the light to correspond to the updated weighted current, and assigning the updated weighted current to the weighted current.

12. The method of claim 9, wherein the weighting coefficient ranges from approximately 90 to approximately 99.

13. The method of claim 9, wherein the real time current flowing through the light source changes in response to a change in a setting of a dimmer.

14. A lighting device for adjusting a color of a light, the lighting device comprising:

a light source configured to emit a light;

a driver to provide power to the light source;

a dimmer in electrical communication with the driver, wherein a real time current flowing through the light source corresponds to a setting of the dimmer; and a color controller comprising a current measurement circuit, the color controller to iteratively adjust a color of the light to match a target color of the light, the target color of the light corresponding to the real time current, wherein, at each iteration, the color controller determines an updated weighted current based on a combination of a portion of a weighted current and a portion of the real time current, wherein the weighted current corresponds to a current color of the light, wherein the color controller adjusts the color of the light to correspond to the updated weighted current, wherein the portion of the weighted current is a weighting coefficient % of the weighted current, wherein the portion of the real time current is (1−the weighting coefficient) % of the real time current, and wherein the color controller determines the updated weighted current by summing the portion of the weighted current and the portion of the real time current.

15. The lighting device of claim 14, wherein, at each iteration, the color controller assigns the updated weighted current to the weighted current for use an immediately subsequent iteration.

16. The lighting device of claim 14, wherein the light source comprises multiple light sources that emit different color lights, wherein the light is a combination of the different color lights, wherein the color controller adjusts the color of the light to correspond to the updated weighted current by changing a contribution of at least a first light of the different color lights in the combination of the different color lights.

17. The lighting device of claim 14, wherein the weighting coefficient ranges from approximately 90 to approximately 99.

* * * * *